US009976413B2

(12) United States Patent
Cramer et al.

(10) Patent No.: US 9,976,413 B2
(45) Date of Patent: May 22, 2018

(54) PRESSURE LOCKING DEVICE FOR DOWNHOLE TOOLS

(71) Applicant: APS Technology, Inc., Wallingford, CT (US)

(72) Inventors: David Cramer, Okotoks (CA); Andrew Roberts, Meriden, CT (US); Carl Allison Perry, Middletown, CT (US)

(73) Assignee: APS Technology, Inc., Wallingford, CT (US)

( * ) Notice: Subject to any disclaimer, the term of this patent is extended or adjusted under 35 U.S.C. 154(b) by 263 days.

(21) Appl. No.: 14/627,806

(22) Filed: Feb. 20, 2015

(65) Prior Publication Data

US 2016/0245068 A1 Aug. 25, 2016

(51) Int. Cl.

| | |
|---|---|
| ***E21B 47/12*** | (2012.01) |
| ***E21B 47/06*** | (2012.01) |
| ***E21B 7/06*** | (2006.01) |

(52) U.S. Cl.

CPC ..... *E21B 47/12* (2013.01); *E21B 7/06* (2013.01)

(58) Field of Classification Search

CPC ..... E21B 47/01; E21B 17/02; E21B 23/02; E21B 23/03; E21B 23/04

See application file for complete search history.

(56) References Cited

U.S. PATENT DOCUMENTS

| | | | | |
|---|---|---|---|---|
| 2,225,668 A | | 12/1940 | Subkow | |
| 3,394,939 A | | 7/1968 | A Mastro | |
| 3,411,584 A | * | 11/1968 | Sizer | E21B 34/105 166/322 |
| 3,518,609 A | | 6/1970 | Fontenot | |

(Continued)

FOREIGN PATENT DOCUMENTS

| | | | | |
|---|---|---|---|---|
| CA | 2760931 A1 | * | 6/2013 | E21B 23/02 |
| CA | 2786471 A1 | * | 7/2013 | E21B 47/011 |

(Continued)

OTHER PUBLICATIONS

International Patent Application No. PCT/US2014/066801; Notification of Transmittal of the International Search Report and the Written Opinion of the International Searching Authority dated Jul. 21, 2015, 16 pgs.

(Continued)

*Primary Examiner* — Jennifer H Gay

(74) *Attorney, Agent, or Firm* — Baker & Hostetler LLP

(57) ABSTRACT

A system and method for pressure locking a downhole tool in position during a drilling operation includes rotating the drill string to drill a borehole. A fluid is pumped through a passage of a drill string in the downhole direction wherein fluid undergoes a pressure drop at the downhole end of the drill string such that fluid in the passage of the drill string is under higher pressure than the fluid outside the drill string. While fluid is flowing, an uphole portion of the downhole tool, such as a MWD tool, is exposed to the higher pressure fluid and a downhole portion of the downhole tool to the (Continued)

lower pressure fluid, thereby seating the downhole tool in a receptacle member attached to the drill string in the passage. Ceasing flow easily eliminates the locking force created by differential pressure allowing the tool to be retrieved.

22 Claims, 13 Drawing Sheets

(56) References Cited

U.S. PATENT DOCUMENTS 3,765,494 A * 10/1973 Kielman, Jr. ..... E21B 17/00 175/320
3,765,690 A 10/1973 Sievenpiper
4,066,128 A 1/1978 Davis
4,130,162 A * 12/1978 Nelson ..... E21B 47/024 166/243
4,216,536 A 8/1980 More
4,348,672 A 9/1982 Givler
4,416,330 A 11/1983 Merritt
RE31,613 E 6/1984 Lienhard
4,566,702 A 1/1986 Traub
4,630,243 A 12/1986 MacLeod
4,689,775 A * 8/1987 Scherbatskoy ..... E21B 47/185 175/48
4,825,946 A 5/1989 Schnatzmeyer
4,893,823 A 1/1990 Strouse et al.
4,980,682 A 12/1990 Klein
5,045,795 A 9/1991 Gianzero
5,065,099 A 11/1991 Sinclair
5,163,692 A 11/1992 Schofield et al.
5,189,415 A 2/1993 Shimada
5,326,112 A 7/1994 Paykin
5,328,685 A 7/1994 Janchitraponvej
5,463,313 A 10/1995 Berkan
5,606,260 A 2/1997 Giordano
5,767,667 A 6/1998 Shafie
5,782,261 A 7/1998 Becker
5,818,352 A 10/1998 McClure
5,955,884 A 9/1999 Payton et al.
5,959,548 A 9/1999 Smith
5,979,904 A 11/1999 Baisells
6,018,602 A 1/2000 Smith
6,111,409 A 8/2000 Edwards
6,364,035 B2 4/2002 Brune et al.
6,367,323 B1 * 4/2002 Camwell ..... E21B 21/08 73/152.03
6,411,078 B1 6/2002 Nakagawa
6,417,666 B1 7/2002 Mercer
6,456,059 B1 9/2002 Blakely
6,470,274 B1 10/2002 Mollison et al.
6,531,871 B1 3/2003 Hay et al.
6,657,597 B2 12/2003 Rodney
6,712,362 B2 3/2004 Krappmann et al.
6,810,955 B2 11/2004 Roth
6,896,050 B2 5/2005 Biglen et al.
6,915,848 B2 7/2005 Thomeer
6,915,849 B2 7/2005 Nuth
7,151,466 B2 12/2006 Gabelmann
7,170,423 B2 1/2007 Wisler
7,178,608 B2 2/2007 Mayes
7,204,309 B2 4/2007 Segura
7,213,607 B2 5/2007 De Almeida
7,243,028 B2 7/2007 Young
7,296,639 B2 11/2007 Millar et al.
7,327,144 B2 2/2008 Brune
RE40,321 E 5/2008 Srnka
7,480,207 B2 1/2009 Marsh
7,506,699 B1 * 3/2009 Harvey ..... E21B 23/006 166/117.5
7,506,700 B1 * 3/2009 Harvey ..... E21B 23/006 166/117.5
7,681,663 B2 3/2010 Cobern
7,775,301 B2 8/2010 Brune et al.
7,832,503 B2 11/2010 Sand et al.
8,069,931 B2 12/2011 Hooks
8,096,559 B2 1/2012 Cook
8,154,420 B2 4/2012 Petrovic
8,240,672 B2 8/2012 Grace et al.
8,284,073 B2 10/2012 Mehta et al.
8,400,326 B2 3/2013 Codazzi
8,463,548 B2 6/2013 Gies
8,464,798 B2 6/2013 Nadkrynechny
8,474,548 B1 7/2013 Young
8,891,811 B2 11/2014 Alattar
8,952,700 B2 2/2015 Wisler
9,116,255 B2 8/2015 Eick
9,196,411 B2 11/2015 Parsche
9,234,981 B2 1/2016 Rodney et al.
9,274,243 B2 3/2016 Chau et al.
9,291,049 B2 3/2016 Switzer et al.
9,303,465 B2 4/2016 Pare
9,328,603 B2 5/2016 Pope
9,453,397 B2 9/2016 Dowling et al.
9,562,987 B2 2/2017 Guner et al.
9,575,201 B2 2/2017 Wang
2002/0170711 A1 11/2002 Nuth
2003/0184488 A1 10/2003 Smith
2003/0229450 A1 12/2003 Strickland
2004/0004553 A1 1/2004 Rodney
2004/0035575 A1 2/2004 Roth
2004/0100256 A1 5/2004 Fickert
2004/0104047 A1 6/2004 Peter
2004/0156264 A1 8/2004 Gardner
2004/0169367 A1 9/2004 Sutherland
2004/0226749 A1 * 11/2004 Biglin, Jr. ..... E21B 21/10 175/45
2004/0251897 A1 12/2004 Pedersen
2004/0257061 A1 12/2004 George de Buda
2005/0016771 A1 * 1/2005 Mayes ..... E21B 47/00 175/48
2005/0046587 A1 3/2005 Wisler
2005/0061369 A1 3/2005 De Almeida
2005/0140373 A1 6/2005 Li
2006/0035591 A1 2/2006 Young et al.
2006/0041795 A1 2/2006 Gabelmann
2006/0066292 A1 3/2006 Tadatsu
2006/0118298 A1 * 6/2006 Millar ..... E21B 7/061 166/242.7
2006/0124354 A1 6/2006 Witte
2006/0202852 A1 9/2006 Peter et al.
2007/0052407 A1 3/2007 Hausperger
2007/0079988 A1 4/2007 Konschuh
2007/0239403 A1 10/2007 Hornbostel
2007/0247328 A1 10/2007 Petrovic
2007/0251729 A1 11/2007 Sand et al.
2008/0048655 A1 2/2008 Hausperger
2008/0224707 A1 9/2008 Wisler et al.
2008/0265892 A1 10/2008 Snyder
2009/0261986 A1 10/2009 Mehta et al.
2010/0033187 A1 2/2010 Reiderman
2010/0052689 A1 3/2010 Hall
2010/0134112 A1 6/2010 Zhang
2010/0258351 A1 10/2010 Hooks
2010/0262370 A1 10/2010 Bittar et al.
2010/0270491 A1 10/2010 Faas
2011/0001633 A1 1/2011 Lam et al.
2011/0006753 A1 1/2011 Yu
2011/0017512 A1 1/2011 Codazzi
2011/0061864 A1 * 3/2011 Umphries ..... E21B 23/00 166/255.2
2011/0140369 A1 6/2011 Lenhert
2011/0253382 A1 * 10/2011 Nadkrynechny ..... E21B 43/121 166/372
2011/0304220 A1 12/2011 Whitehead
2012/0062215 A1 3/2012 Ide
2012/0091996 A1 4/2012 Koch
2012/0126992 A1 5/2012 Rodney et al.
2012/0286478 A1 11/2012 Uesugi
2013/0009646 A1 1/2013 Simon
2013/0014992 A1 1/2013 Sharp
2013/0043661 A1 2/2013 Binder et al.
2013/0077440 A1 3/2013 Cao et al.

(56) References Cited

U.S. PATENT DOCUMENTS

| | | | | |
|---|---|---|---|---|
| 2013/0140019 | A1* | 6/2013 | Pare | E21B 17/06 166/117.5 |
| 2013/0169278 | A1 | 7/2013 | Bittar et al. | |
| 2013/0176139 | A1 | 7/2013 | Chau et al. | |
| 2013/0234717 | A1 | 9/2013 | Wang | |
| 2013/0241561 | A1 | 9/2013 | Allen | |
| 2013/0241742 | A1 | 9/2013 | Contant et al. | |
| 2013/0265171 | A1 | 10/2013 | Hay | |
| 2013/0278252 | A1 | 10/2013 | Sasaki | |
| 2013/0320940 | A1 | 12/2013 | Dimitrovski | |
| 2013/0337650 | A1 | 12/2013 | Lee et al. | |
| 2014/0032116 | A1 | 1/2014 | Guner | |
| 2014/0041863 | A1* | 2/2014 | Dowling | E21B 43/123 166/250.01 |
| 2014/0048332 | A1* | 2/2014 | Schmidt | E21B 47/011 175/45 |
| 2014/0110395 | A1 | 4/2014 | Parsche | |
| 2014/0240140 | A1 | 8/2014 | Switzer et al. | |
| 2015/0053485 | A1 | 2/2015 | Altimas et al. | |
| 2015/0075770 | A1 | 3/2015 | Fripp | |
| 2015/0145687 | A1* | 5/2015 | Roberts | E21B 47/122 340/853.2 |
| 2015/0218938 | A1 | 8/2015 | Weisbeck et al. | |
| 2015/0247401 | A1 | 9/2015 | Cramer | |
| 2015/0276970 | A1 | 10/2015 | Wu | |
| 2015/0285061 | A1 | 10/2015 | Wu | |
| 2015/0293254 | A1 | 10/2015 | Wang | |
| 2015/0337650 | A1 | 11/2015 | Balogh | |
| 2016/0003035 | A1 | 1/2016 | Logan et al. | |
| 2016/0138388 | A1 | 5/2016 | Chau et al. | |
| 2016/0146000 | A1 | 5/2016 | Logan et al. | |
| 2016/0187523 | A1 | 6/2016 | Sanmartin | |
| 2016/0245068 | A1* | 8/2016 | David Cramer | E21B 47/12 |
| 2016/0290066 | A1* | 10/2016 | Frith | E21B 47/024 |
| 2016/0369615 | A1* | 12/2016 | Cune | E21B 47/011 |

FOREIGN PATENT DOCUMENTS

| | | | |
|---|---|---|---|
| EP | 0911484 | A2 | 4/1999 |
| EP | 0913555 | A2 | 5/1999 |
| EP | 0922836 | A1 | 6/1999 |
| GB | 2008899 | A | 6/1979 |
| WO | WO2006028701 | A2 | 3/2006 |
| WO | WO2012175658 | A2 | 6/2012 |
| WO | WO 2015/077552 | | 5/2015 |
| WO | WO 2015/134361 | | 9/2015 |
| WO | WO 2015/179331 | | 11/2015 |

OTHER PUBLICATIONS

International Patent Application No. PCT/US2015/018249; Notification of Transmittal of the International Search Report and the Written Opinion of the International Searching Authority dated May 21, 2015, 10 pgs.

International Patent Application No. PCT/US2015/031467; Notification of Transmittal of the International Search Report and the Written Opinion of the International Searching Authority dated Aug. 19, 2015, 8 pgs.

Velasco-Quesada, Novel Advances in Microsystems Technologies and Their Applications, CRCPress, Chapter 21, Aug. 2013, p. 348, 3 pgs.

* cited by examiner

PRESSURE LOCKING DEVICE FOR DOWNHOLE TOOLS

TECHNICAL FIELD

The present disclosure relates to a pressure locking device for drilling systems and components thereof, and more specifically, to a pressure locking device for holding downhole tools, such as measurement-while-drilling tools and the like, in position along a drill string while drilling a borehole in an earthen formation.

BACKGROUND

Boreholes are drilled thousands of feet underground for oil, gas, and other purposes. Drilling is accomplished by utilizing a series of connected pipes called a drill string. At the bottom of the string is a drill bit. The drill bit turns either by rotating the drill string or by a fluid, typically referred to as "drilling mud" that travels through an internal passage in the drill string. The drilling mud powers a motor near drill bit. The drill bit advances into the earth, thereby forming the borehole. A high pressure fluid, the drilling mud, is pumped down through internal passage of the drill string to the drill bit so as to lubricate the drill bit and to flush cuttings from its path. The drilling fluid F then flows to the surface through an annular passage formed between the drill string and the surface of the bore hole.

Data regarding the downhole drilling operation and environment is often transmitted from sensors located near the drill bit to the surface while the borehole is being drilled. Obtaining and transmitting drilling data between sensors located downhole and the surface is commonly referred to as measurement-while-drilling (MWD) and logging-while-drilling (LWD), which are collectively referred to as MWD throughout this document. Often, a transmitter and sensor package is part of an MWD tool. Typical data includes formation characteristics, borehole direction and inclination, and various other drilling parameters.

MWD tools can be a fixed-mount tools that are permanently fixed to the drill collar, or retrievable tools configured so that all or part of the MWD tool can be retrieved from the drill collar as needed. A fixed mount tool has some advantages, but a drawback is that if the drill string becomes permanently stuck, the expensive MWD tool is also stuck. A retrievable tool, in contrast, can be pulled out of the drill string even if the drill string is permanently stuck and lost. Retrievable tools typically include a probe, sometimes called a stinger, that seats in a mule shoe mounted inside a section of drill collar located toward the drill bit. The mule shoe includes a socket into which the probe inserted. In conventional retrievable tools, grooves align the probe in the socket of the mule shoe to orient the probe. In the event the drill string gets stuck, a wireline is used to lower a device which can attach to a spear point mounted on the uphole end of the retrievable MWD tool. When the wireline is attached to the retrievable MWD tool, the tool can be pulled up to the surface through the internal passage of the drill string.

Drilling can cause the drill bit to move up and down violently against the earthen formation. In order for accurate information to be provided by the MWD tool, the probe should be seated properly and securely in the mule shoe. If the probe is not properly seated, the sensors might make erroneous measurements due to the axial movement of the drill bit. For example, if the probe is not seated properly in the mule shoe, a directional sensor in the MWD tool may be come misaligned with axis of the drill string and the formation, and in this way provide incorrect information, which can result in steering the borehole in a wrong direction. Some minor up and down movement of the probe is acceptable during drilling. However, even in vertical boreholes where the weight of the MWD tool tends to keep the probe in place, some means for holding the tool in place relative to the socket is desirable to minimize axial vibration which can result in inaccurate measurements, damage to sensors, and premature wear and failure. While the probe should be properly seated in the mule shoe across a range of operating conditions downhole, it should also be easy to release the probe when necessary for retrieval.

Previous designs have utilized latching mechanisms to overcome the issue of keeping downhole equipment securely in place. See for example, U.S. Pat. No. 6,896,050, assigned to the APS Technology, Inc. However, latches have reliability concerns because they can be made of small moving parts exposed to fast flowing, abrasive drilling fluid F. In addition, the shock forces can be large, and latch mechanisms are subject to breaking. Accordingly, there is opportunity for improvement in the art.

SUMMARY

A system and method of holding drilling equipment in place during drilling operation which utilizes the differential pressure between drilling fluid inside and outside the drill string. In this regard, during drilling, drilling fluid is pumped down the inside of the drill string through the drill bit. The drilling fluid is propelled by pumps at the surface and flows under high pressure inside the drill string. The drilling fluid F moves past the drilling equipment and through or around a socket, past the mud motor if installed, and then to the drill bit. The drilling fluid F is then forced through nozzles in the drill bit and makes a return trip uphole on the outside of the drill string. The region outside of the drill string, i.e., the annulus, and the drilling fluid F in the annulus is considered downstream of the drilling equipment, motor, drill bit, and anything inside of the drill string. The pressure of the drilling fluid drops as it moves downstream, as is the case in any non-compressible flow system. And, when fluid flows through a restriction, its velocity increases and dynamic pressure decreases.

Once the drilling fluid F is past the drill bit, the fluid is under lower pressure in the annulus of the bore hole than the pressure inside of the drill string because of the pressure drop across the drill bit and other structure and devices at the borehole end. The drilling equipment located within the drill string and under high pressure is exposed to the low pressure fluid in the annulus by a channel or port that extends through the drill string and into the annulus. The difference in pressure causes the high pressure side to push toward the low pressure side causing the equipment to seat firmly in the socket. The force that pushes the equipment down exceeds the majority of the forces that tend to unseat the tool upwards while drilling.

An embodiment of present disclosure includes a system having a drill collar segment configured to disposed along the drill string, the drill collar segment including a passage configured for high pressure drilling fluid to flow through along a downhole direction when the drill collar segment is disposed along the drill string. The drill collar segment configured such that the high pressure fluid drops in pressure across a downhole end of the drill string, thereby resulting in lower pressure drilling fluid on an exterior surface of the drill collar segment. The system includes a mule shoe coupled to the drill collar segment. The mule shoe includes a socket. The system includes a probe configured to be positioned in the passage of the drill collar segment. The probe has a downhole end configured to be disposed in the socket. The system includes at least one sealing element coupled to one of the probe or the mule shoe so as define a seal between the probe and the mule shoe. The sealing element defines an uphole side of the probe and a downhole side of the probe. The uphole side of probe is in communication with the high pressure drilling fluid and the downhole side being in communication with the low pressure drilling fluid, whereby the pressure differential between the high pressure fluid and the low pressure fluid applies a force to the probe in the downhole direction.

Another embodiment of present disclosure includes a system having a drill collar segment configured to disposed along the drill string. The drill collar segment defines an inner surface, an outer surface, an uphole end, a downhole end spaced from the uphole end in the downhole direction, and a passage that extends from the uphole end to the downhole end in the downhole direction. The passage is configured to allow a fluid to flow therethrough. The system includes a downhole tool configured to be positioned in the passage. The downhole tool has a first end and a second end that is opposed to the first end along the downhole direction. The system includes a receptacle member supported by the inner surface of the drill collar segment. The receptacle member defines a socket configured to engage the second end of the downhole tool, and a channel that is open to the socket and to an outer surface the drill collar segment. Engagement between the second end of the downhole tool and the socket forms a seal between the downhole tool and the receptacle member. When fluid flows through the passage during the drilling operation, a differential pressure between a high pressure fluid at an uphole side of the seal and a lower pressure fluid on a downhole side of the seal applies a force to the downhole tool in the downhole direction, so as to retain the downhole tool in the receptacle member.

An embodiment of present disclosure includes a method for drilling a borehole in an earthen formation with a drill string. The method includes rotating the drill string so as to drill the borehole. The method includes pumping a fluid through the passage of the drill string in the downhole direction, wherein the fluid undergoes a pressure drop at the downhole end of the drill string such that fluid in the passage of the drill string is under higher pressure than the fluid outside the drill string. The method also includes, during the pumping step, exposing an uphole portion of the downhole tool to the higher pressure fluid and a downhole portion of the downhole tool to the lower pressure fluid, thereby seating the downhole tool in a receptacle member attached to the drill string in the passage.

BRIEF DESCRIPTION OF THE DRAWINGS

The foregoing summary, as well as the following detailed description of illustrative embodiments of the present application, will be better understood when read in conjunction with the appended drawings. For the purposes of illustrating the present application, there is shown in the drawings illustrative embodiments of the disclosure. It should be understood, however, that the application is not limited to the precise arrangements and instrumentalities shown. In the drawings.

DETAILED DESCRIPTION OF ILLUSTRATIVE EMBODIMENTS

Figure 1A:
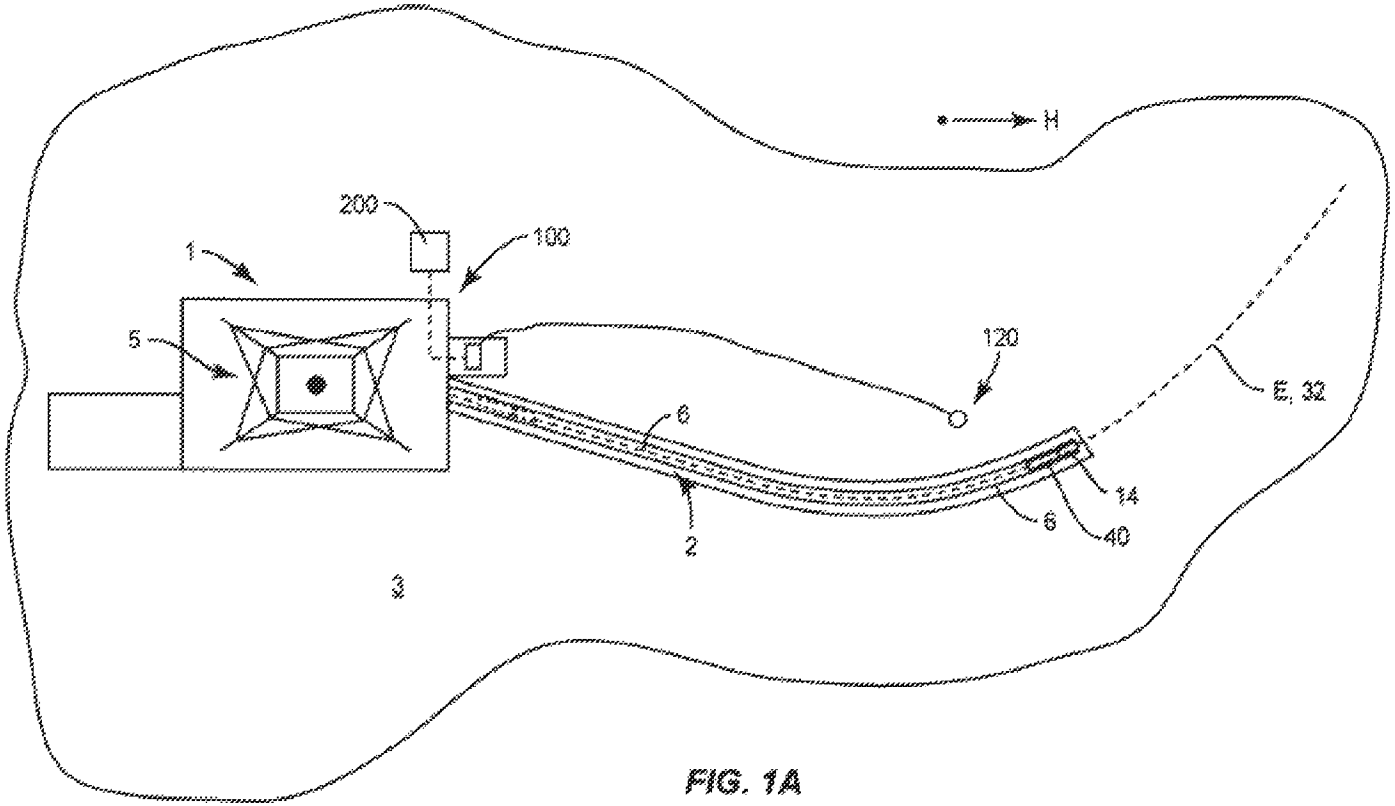
FIG. 1A is a schematic plan view of a drilling system forming a borehole in an earthen formation and including an exemplary MWD tool utilizing a pressure locking device according to an embodiment of present disclosure.
Figure 1B:
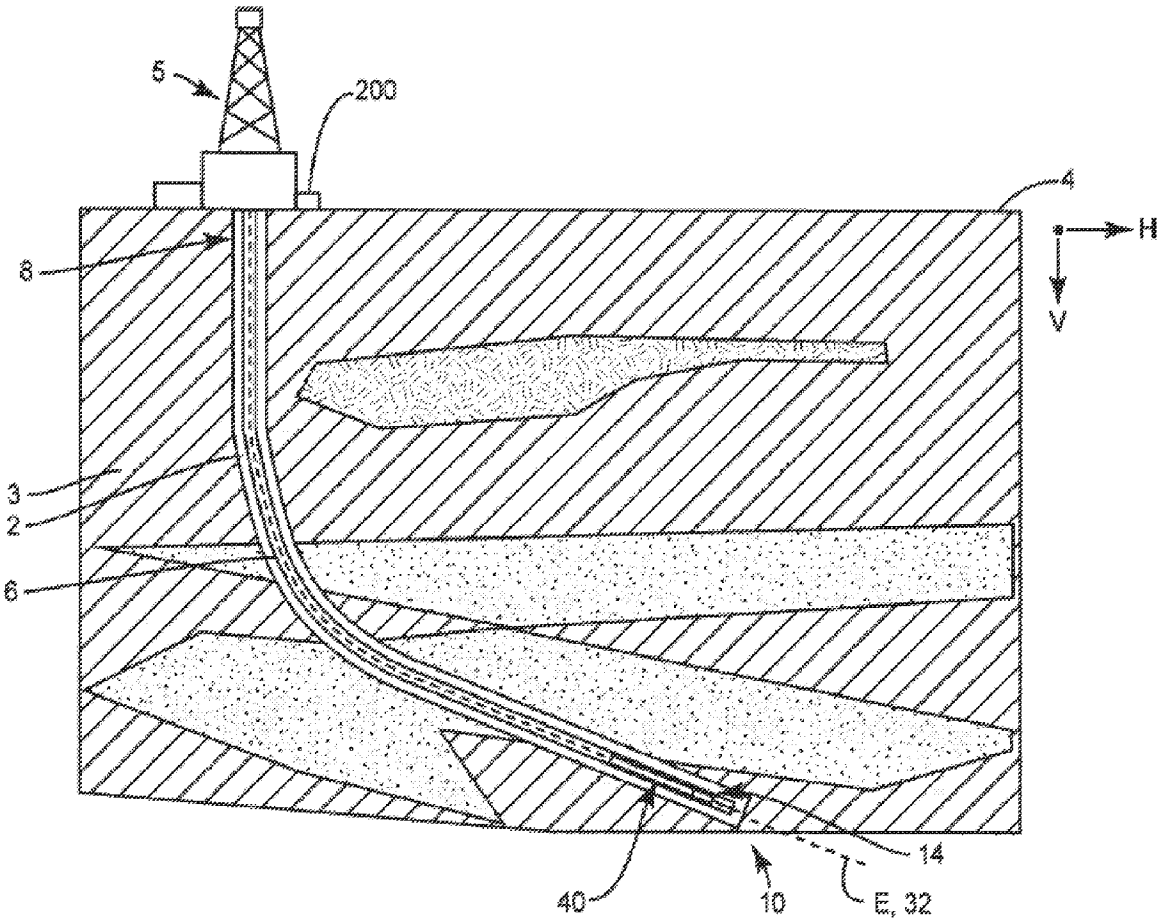
FIG. 1B is a schematic side view of the drilling system shown in FIG. 1A.
Figure 1C:
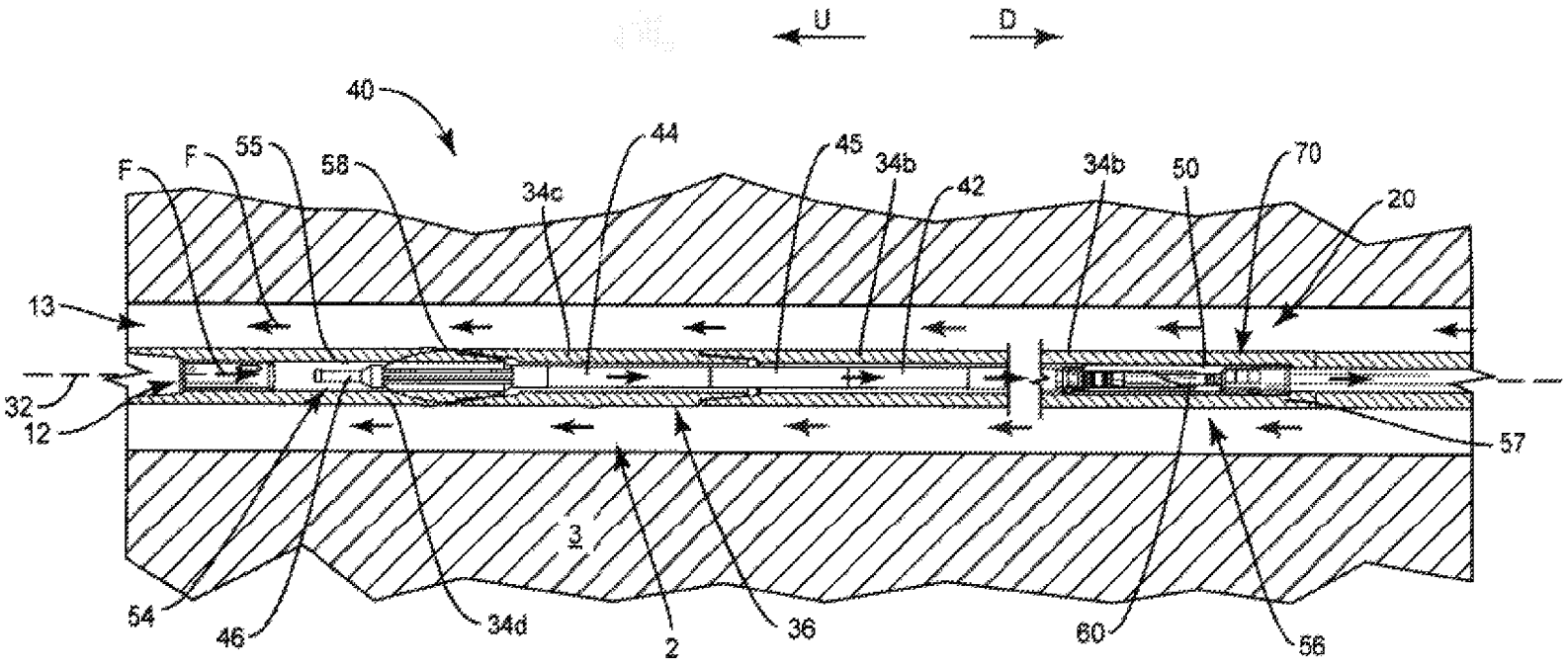
FIG. 1C is a detailed sectional view of the exemplary MWD tool and pressure locking device shown in FIG. 1A.
Figure 5:
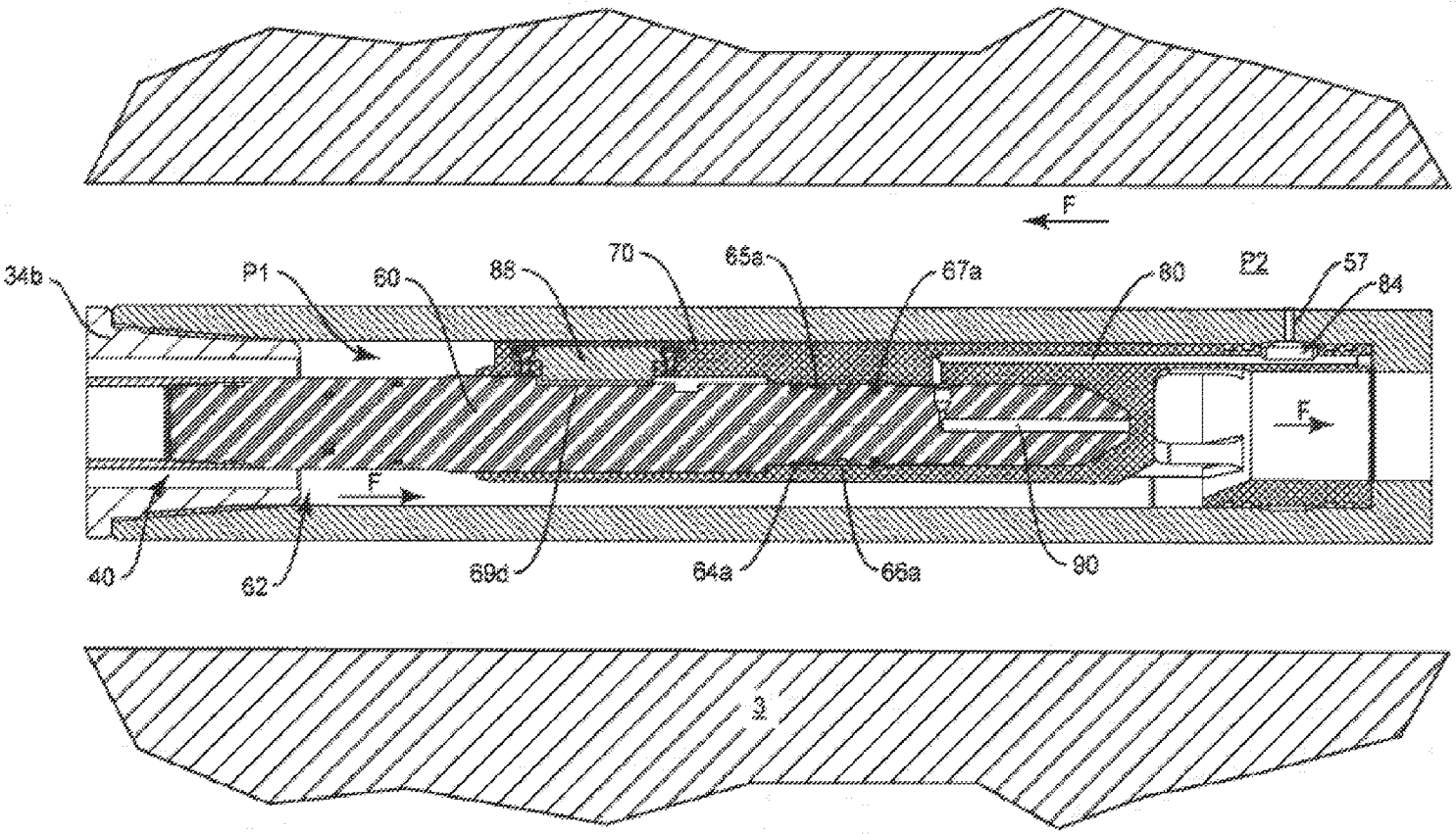
FIG. 5 is a sectional view of the downhole end of the MWD tool fully seated in the socket of the mule shoe shown in FIG. 4C in the borehole, showing the MWD tool and mule shoe at different orientation from FIG. 4C.

Referring to FIGS. 1A-1C, a drilling system 1 includes a drill string 6 is configured to drill a borehole 2 in an earthen formation 3, such as used to access a target hydrocarbon source. Drilling system 1 includes a pressure locking device 20 disposed inside the drill string 6 for maintaining a downhole tool, such as an MWD tool 40, in position during a drilling operation. As explained more fully below, the pressure locking device 20 includes a drill collar segment 34*a* that supports a receptacle member 70, and at least a portion of MWD tool 40 that is received by a socket 76 (FIG. 3C) defined by the receptacle member 70. The receptacle member 70 can be a mule shoe as is known in the art and in some instances in the present disclosure, the receptacle member 70 is referred to as the mule shoe. The MWD tool 40 is preferably a retrievable-type MWD tool 40. As shown in FIGS. 1C and 5, the pressure locking device 20 is configured so that the MWD tool 40 is seated in socket 76 by the differential pressure between the drilling fluid F flowing within an internal passage 12 of the drill string 6, and the drilling fluid F flowing in an annular passage 13 between the drill string 6 and the wall (not numbered) of borehole 2. When the drilling system 1 is not performing drilling operations, there is no longer significant differential pressure holding the downhole end of the MWD tool 40 in place in the receptacle member 70, and therefore, the MWD tool 40 can be retrieved from drill string 6.

As best illustrated in FIGS. 1A-1C, drilling system 1 includes a derrick 5 that supports the drill string 6. The drill string 6 includes several drill string components that define the drill string 6 and the internal passage 12. Drill string components include one or more subs, stabilizers, drill pipe sections, and drill collars and bottomhole assembly (BHA), and a drill bit 14 that define the drill string 6. The drill string 6 in the embodiment shown includes an MWD tool 40, as further detailed below. The drill string 6 is elongated along a central longitudinal axis 32 and includes a top end 8 and a bottom end 10 spaced from the top end 8 along the central longitudinal axis 32. The drill bit 14 is positioned at the bottom end 10 of the drill string 6. As used herein, downhole or downhole location means a location closer to the bottom end 10 of the drill string 6 than the top end 8 of the drill string 6. Accordingly, a downhole direction D refers to the direction from the surface 4 toward a bottom end (not numbered of the borehole 2), while an uphole direction U refers the direction from the bottom end of the borehole 2 toward the surface 4. The drilling system 1 also includes one or more motors control rotation of the drill string 6 and/or the drill bit 14. Surface motors (not shown) at the surface 4 rotate the drill string 6 via a top drive or rotary table. A downhole or "mud motor" rotates drill bit 14 independent of rotation of the drill string 6.

The drilling system 1 can create a significant differential pressures between drilling fluid F in the internal passage 12 of the drill string 6 and the drilling fluid F located outside the drill string 6 in the annular passage 13. In typical drilling systems, a pump will pump drilling fluid F, known as drilling mud, downward through the internal passage 12 in the drill string 6. When the drilling mud exits the drill string 6 at the drill bit 14, the returning drilling fluid F flows upward toward the surface 4 through the annular passage 13 formed between the drill string 6 and a wall (not numbered) of the borehole 2. The combination of the pump outlet pressure and the pressure head yields high pressure drilling fluid F in passage 12 of the drill string 6 near the downhole end of the borehole 2, as is well known in the art. A pressure drop across the drill bit 14, mud motor (if present), and other downhole equipment yields a pressure on the outside of drill string 6 at the borehole end near the drill bit 14 that is significantly less than pressure of the drilling fluid F within the drill string 6. For instance, using fluid under high pressure to rotate a shaft in the downhole motor accomplishes work resulting in a pressure drop as the drilling fluid F is forced through the downhole motor. Flow under high pressure forced through the reduced area of the nozzles in the drill bit 14 results in a further decrease in pressure and increase in velocity. Fluid pressure in the annulus passage 13 after passing through the downhole motor and drill bit 14 is considerably lower than the fluid pressure of the fluid before the fluid has passed through the downhole motor and drill bit. It should be appreciated that the particular downhole motor and drill bit nozzle design can result in different pressure drops. In some cases, the pressure drop across the downhole motor is about equal to the process drop across the drill bit 14. In any event, the pressure locking device 20 is configured so that differential pressure between drilling fluid F in the internal passage 12 of the drill string 6 and the drilling fluid F located outside the drill string 6 in the annular passage 13 causes the MWD tool 40 to fully seat in the receptacle member 70 as will be further detailed below.

Continuing with FIGS. 1A and 1B, drilling system 1 is configured to drill the borehole 2 in an earthen formation 3 along a borehole axis E such that the borehole axis E extends at least partially along a vertical direction V and optionally along an offset direction H. The vertical direction V refers to a direction that is approximately perpendicular to the surface 4 of the earthen formation 3. Thus, it should be appreciated that the drill string 6 can be configured for directional drilling, whereby all or a portion of the borehole 2 is angularly offset with respect to the vertical direction V along the offset direction H. The offset direction H is at angularly offset with respect to the vertical direction V so as to be aligned with or parallel to the surface 4, and angled relative to the surface 4. Thus, the offset direction H can extend along any direction that is perpendicular to the vertical direction V, for instance north, east, south and west, as well as any incremental direction between north, east, south and west.

Turning to FIG. 1C, the drill string 6 includes several drill collar segments 34*a*, 34*b*, 34*c*, and 34*d* connected end-to-end along the central longitudinal axis 32 to define a drill collar assembly 36. One up to all of the drilling collar segments can be connected together during make-up at the drill site to define the drill collar assembly 36. In other embodiments, however, two or more of the drill collar segments may be connected end-to-end prior to make-up to define the drill collar assembly 36. As noted above, the drill collar segment 34*a* supports the receptacle member 70 and the MWD tool 40. The drill collar segments can define the inner surface 55, which, in turn, defines the internal passage 12 through which drilling fluid F flows toward the drill bit 14.

As shown in FIG. 1C, the MWD tool 40 is configured to obtain information via the downhole sensors and to cause data transmission to the surface 4 via a telemetry system. Any suitable telemetry system can be used to transmit data between downhole sensors and the surface 4, including, but not limited to, mud-pulse telemetry system, electromagnetic (EM) telemetry system, acoustic telemetry, wireline, and wired-pipe systems. Accordingly, the MWD tool 40 includes one or more sensors 42 electronically connected to a transmission assembly 44, at least one power source 45, and a probe 60. The MWD tool 40 includes a first end 54 and a second end 56 spaced from the first end 54 the central longitudinal axis 32. As illustrated, the first end 54 of can be referred to as the uphole end and the second end 56 can be referred to as the downhole end. The probe 60 can define the downhole end 56 of the MWD tool 40. The sensors 42 can be any typical downhole sensor. The transmission assembly 44 can be communicatively coupled to components of the desired telemetry system to facilitate transmitting data obtained from the sensors 42 to the surface 4. The power source 45, which can be a battery or turbine alternator or both, supplies current to the sensors 42, the transmission assembly 44 and the probe 60 if needed.

In accordance with an exemplary embodiment of the present disclosure, the MWD tool 40 illustrated in FIG. 1C is an EM telemetry configured tool or an "EM tool." An EM tool includes, in addition to the components described above, an electrode component 46 as well as first and second electric contact members 58 and 50 that define electrical contacts with the drill string 6 spaced apart along the central longitudinal axis 32. The contact members 58 and 50 are separated by an insulated gap sub (not shown). Voltage induced along the EM tool between electrical contacts 58 and 50 cause an electromagnetic signal, encoded with drilling data, to travel through the formation 3 to the surface 4 for reception an receiver 200 (FIG. 1B). Details regarding the components and operation of an EM tool and an EM telemetry system is described in U.S. application Ser. No. 14/087,637, filed Nov. 22, 2013. The entire contents of U.S. application Ser. No. 14/087,637 is incorporated by reference into this document. While an EM tool is illustrated in figures, the term "MWD tool" is broadly used herein to include not only MWD tools, but also logging-while drilling (LWD) tools, pressure-while-drilling (PWD) tools, EM telemetry-type (described herein) tools, and a mud pulse telemetry-type tools.

During a drilling operation, the MWD tool 40 is positioned at a downhole location of the drill string 6 toward the drill bit 14. More specifically, the MWD tool 40 is held in place in the internal passage 12 by the second end 56, or probe 60, of the MWD tool 40 being seated in the receptacle member 70. In order for accurate data to be transmitted to the surface 4, it is preferred to have the MWD tool 40 seated securely in the receptacle member 70. The probe 60 is configured to position and orient the MWD tool 40 in the drill collar segment 34*a* as the probe 60 is being inserted inside the receptacle member 70. The probe 60 may also include additional sensors for sensing downhole parameters concerning the drilling fluid F and of the formations surrounding the drill string. Further, the probe may also serve as a conduit, such an electrical conduit, or as a path for wires, to convey sensed parameters to elsewhere in the MWD tool 40.

Figure 2A:
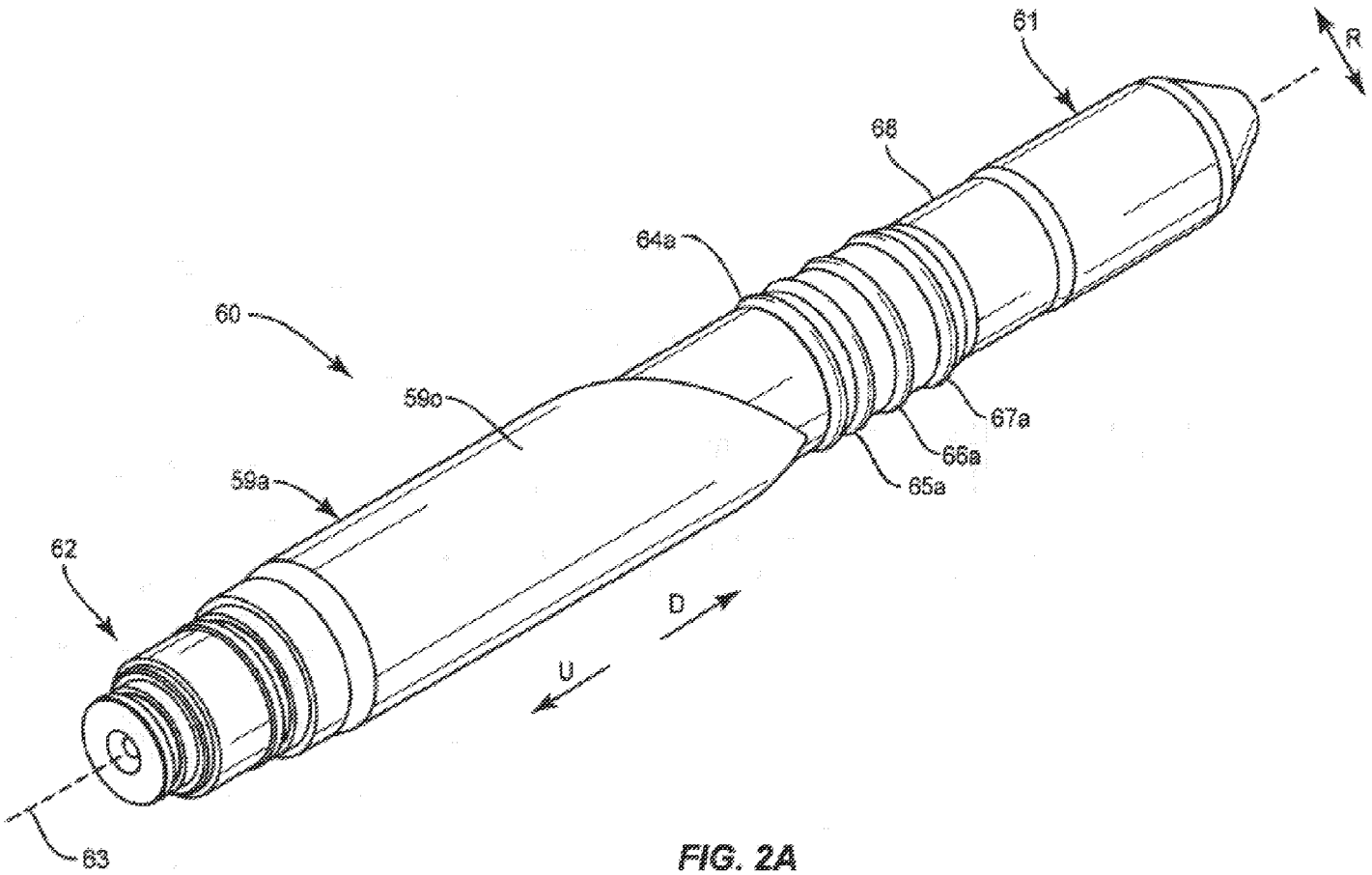
FIG. 2A is a perspective view of a portion of the MWD tool shown in FIG. 1C.
Figure 2B:
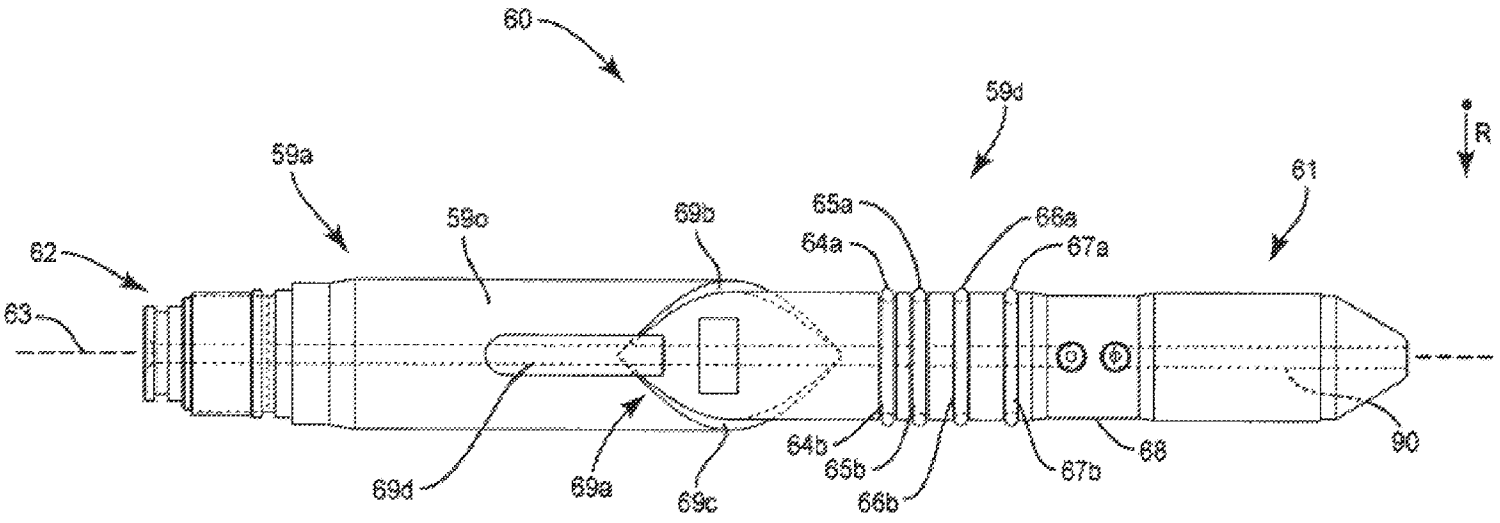
FIG. 2B is a side view of a portion of the MWD tool shown in FIG. 1C.

Referring to FIG. 2A and FIG. 2B, a perspective and side view of the probe or stinger 60 of the MWD tool 40 are shown, respectively. The probe 60 includes a probe body 59*a* that is elongated along a longitudinal axis 63. The probe body 59*a* defines a downhole end 61, an uphole end 62 spaced apart from each other along the longitudinal axis 63, and an outer surface 59*o* spaced from the longitudinal axis 63 along a radial direction R that is perpendicular to the longitudinal axis 63. The downhole end 61 is configured to seat in the receptacle member 70. The uphole end 62 of the probe 60 is configured to be connected to the uphole portion of the MWD tool 40 (uphole portion of MWD tool 40 not shown). It is envisioned that in certain configurations, the socket could be disposed uphole and the stinger can be downhole.

Figure 2C:
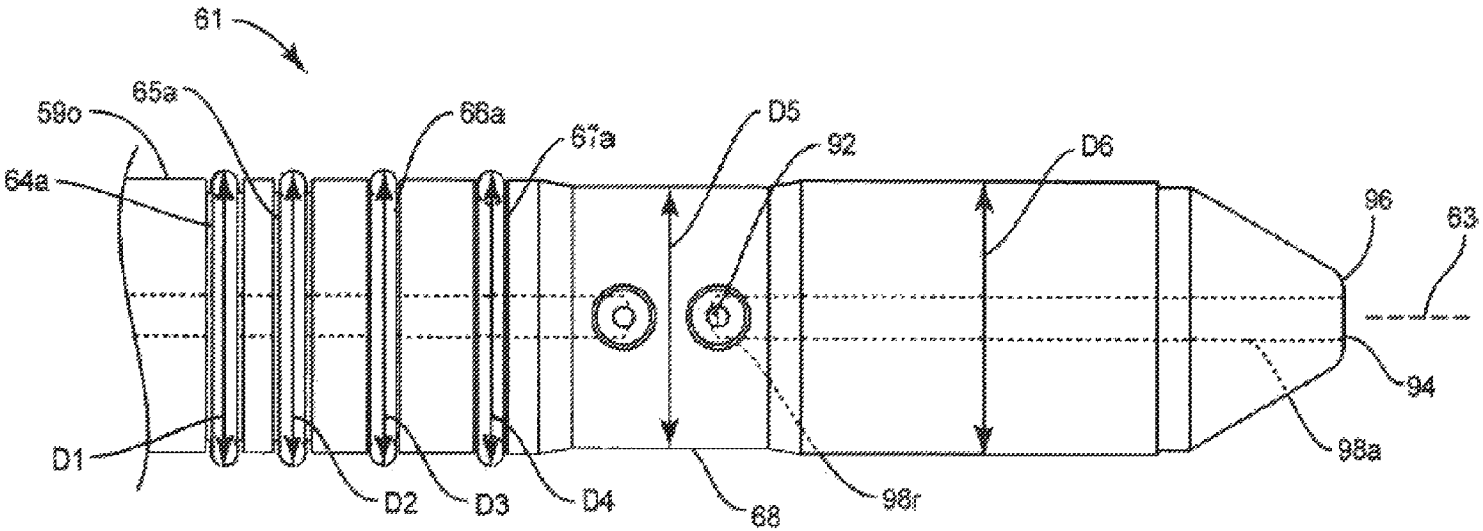
FIG. 2C is a detailed view of a downhole portion of the MWD tool shown in FIG. 2B.

The probe 60 can include at least one sealing element 64*a*. The sealing element 64*a*, or the plurality of sealing elements 64*a* and 65*a* as illustrated in FIGS. 2A-2C, define a seal against an inner surface 78*i* of the receptacle member 70 when the probe 60 is fully seated into the receptacle member 70 (e.g. as shown in FIGS. 4C and 5). Accordingly, each sealing element is compliant to compress against the inner surface 78*i* of the receptacle member 70, thereby defining the seal. The seal divides a high pressure side located uphole relative the sealing elements 64*a* and 65*a* and a lower pressure side located downhole relative to the sealing elements 64*a* and 65*a*. In this regard, the sealing elements 64*a* and 65*a* function as differential pressure sealing elements. Two sealing elements 64*a* and 65*a* are illustrated; a first or uphole sealing element 64*a* and a second or downhole sealing element 65*a*. The downhole sealing element 65*a* can be considered a redundant back-up sealing element. The probe body 59*a* defines a number of annular grooves 64*a* and 65*b* that extend inwardly toward the axis 63. Each sealing element 64*a* and 65*a* can define a ring shape that seats into respective annular grooves 64*b* and 65*b*. The grooves 64*b* and 65*b* also extend around the probe 60 about the longitudinal axis 63 and have a shape that corresponds to the cross-sectional shape of the probe 60. Preferably, the grooves 64*b* and 65*b* are circular and the sealing elements are O-rings. The sealing elements 64*a*, 65*a* extend radially outwardly from the surface 590 of the probe 60 along the radial direction R. In accordance the illustrated embodiment, the first and second sealing elements 64*a* and 65*b* define a first and second outer cross-sectional dimensions D1 and D2 that are perpendicular to the longitudinal axis 63. The sealing element cross-sectional dimensions D1 and D2 are slightly greater than an inner cross-sectional dimension D6 of the receptacle member 70 (see FIG. 3C). Because the sealing elements 64*a* and 65*a* are compliant, the sealing elements 64*a* and 65*a* compress against the inner surface 78*i* of the receptacle member 70 forming a seal against the inner surface 78*i*.

Continuing with FIGS. 2A and 2B, the probe 60 can includes electrical contact component 66*a* disposed around an outer surface 59*o* of the probe 60. The electrical contact component 66*a* is configured to define an electrical connection point with the drill string 6 via the receptacle member 70 when the probe 60 is disposed at least partially in the receptacle member 70. The electrical contact component 66*a* can be a canted spring that seats into an annular groove 66*b* defined by the outer surface 59*o* of the probe 60. The electrical contact component 66*a* can define a third or contact component outer cross-sectional dimension D3 that is perpendicular to the longitudinal axis 63 (see FIG. 2C).

Continuing with FIGS. 2A-2C, the probe 60 can include a locking element 67*a* disposed around the outer surface 59*o* of the probe 60 at a location downhole with respect to the sealing elements 64*a* and 65*a*. The locking element 67*a* is configured provide a redundant lock between the probe 60 and the receptacle member 70 that functions regardless of differential pressure. The locking element 67*a* can be in the form of a ring that is seated into a locking groove 67*b* defined by the outer surface 59*o* of the probe 60. The locking groove 67*b* can extend into the probe body 59*a* in the radial direction toward the longitudinal axis 63 a greater depth compared to a depth of other annular grooves 64*b*, 65*b*, and 66*b* extend into the probe body 59*a*. When the locking element is placed in the groove 67*b*, and the probe is fully seated in receptacle member 70 (FIGS. 4C and 5), the locking element 67*a* extends in an angled groove 78*g* (FIG. 4B) defined in the inner surface 78*i* of receptacle member 70. The locking element 67*a* can define cross-sectional dimension D4 (FIG. 2C) that is perpendicular to the longitudinal axis 63. The locking element cross-sectional dimension D4 is slightly larger than the cross-sectional dimensions D1 and D2 of the sealing elements 64*a* and 65*a* so as to project into the angled groove 78*g* when the probe 60 is fully seated in the receptacle member 70. Configured this way, the locking element 67*a* resists axial movement of the MWD tool 40 in the uphole direction. The locking element 67*a* provides minor locking force when there is no fluid flow to create differential pressure locking described herein. For example, when there is movement of the drill string 6 when drill pipe is added to the drill string 6 during which fluid flow is off, the locking element 67*a* keeps the MWD tool 40 in place. The locking element also serves as a back-up.

Referring to FIGS. 2A, 2B, and 2C, the probe 60 also may include a recess 68 located towards the downhole end 61 relative to sealing elements 64*a* and 65*a*. The recess 68 extends inwardly toward the longitudinal axis 63 along the radial direction R. The outer surface 59*o* of the probe 60 located in the recess 68 defines a fifth or recess cross-sectional dimension D5 that is perpendicular to the longitudinal axis 63. The outer surface 59*o* located downhole with respect to the recess 68 defines body cross-sectional dimension Db that is greater than the recess cross-sectional dimension D5. However, the sealing element cross-sectional dimensions D1 and D2 are larger than a recess cross-sectional dimension D5 and body cross-sectional dimension Db. In addition, the probe 60 also includes a probe channel 90 having a first end or port 92 disposed at the recess 68 and a second end or port 94 disposed at a downhole-most part 96 of the probe 60. The probe channel 90 includes an axial portion 98*a* that extends along the longitudinal axis 63 and an offset portion 98*r* that extends from the axial portion 98*a* to the first end 92 of the recess 87 along the radial direction R. The probe channel 90 permits drilling fluid F trapped between the downhole end 61 of the probe 60 and a downhole surface 78*d* of the receptacle member 70 to pass through the probe 60 and through the receptacle member 70.

Continuing with FIGS. 2A and 2B, the probe 60 includes alignment members 69*a* and 69*d* configured to oriented the probe 60 in the receptacle member 70 such that probe 60 has a particular radial orientation in the drill string 6. This in turn, orients the sensors housed in the MWD tool 40 in the desired orientation in order to obtain accurate data, for instance inclination, and the like. The alignment member 69*a* include a pair ledges 69*b* and 69*c* that extend helically around a portion of the probe 60 about the longitudinal axis 63 and intersect each other at two locations that are 1) circumferentially opposed and spaced at different axial locations along the probe 60. A keyed recess 69*d* is configured to receive a complementary shaped portion of the mule shoe 70.

Figure 3A:
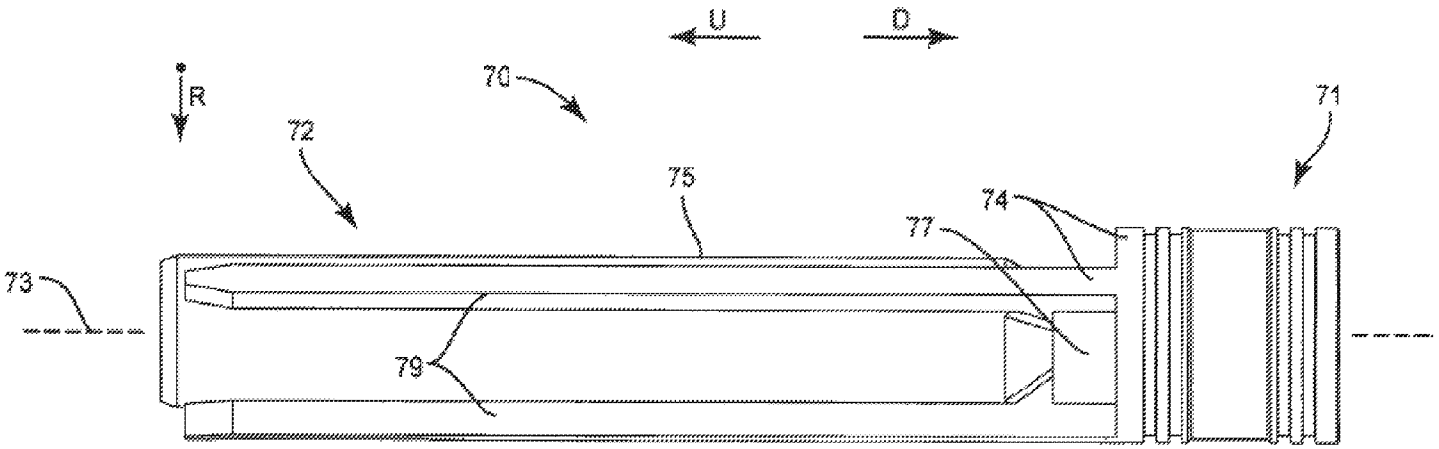
FIG. 3A is a side view of a mule shoe configured to receive the MWD tool shown in FIGS. 2A and 2B.
Figure 3B:
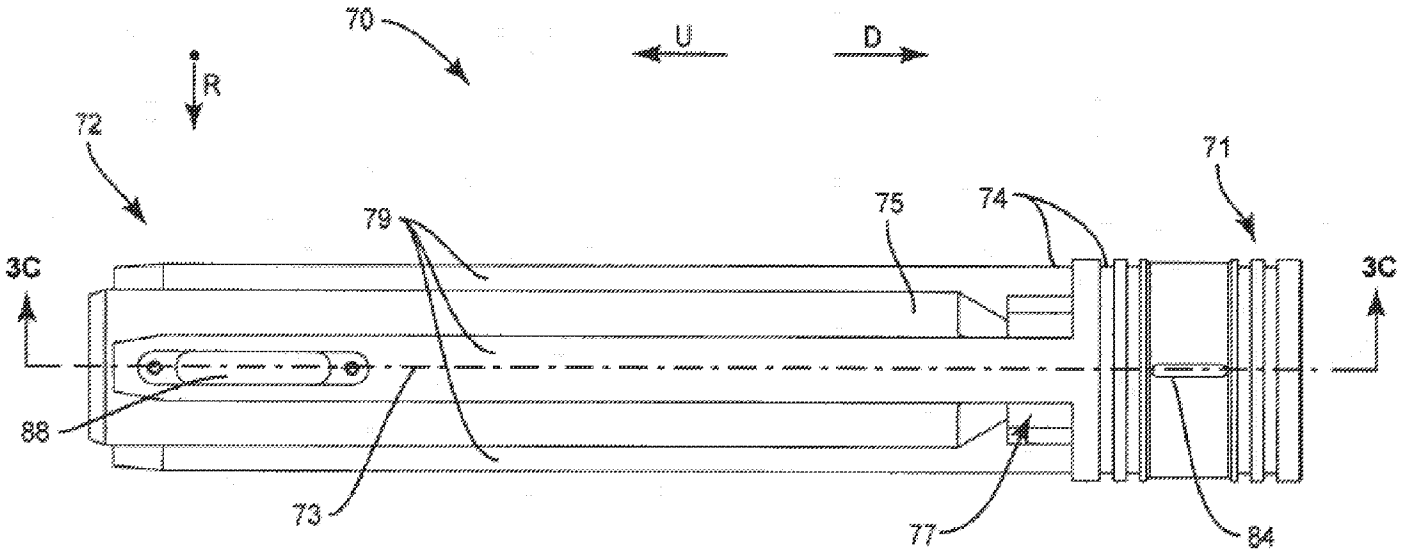
FIG. 3B is another side view of the a mule shoe shown in FIG. 3A, showing the socket in a different orientation from FIG. 3A.
Figure 3C:
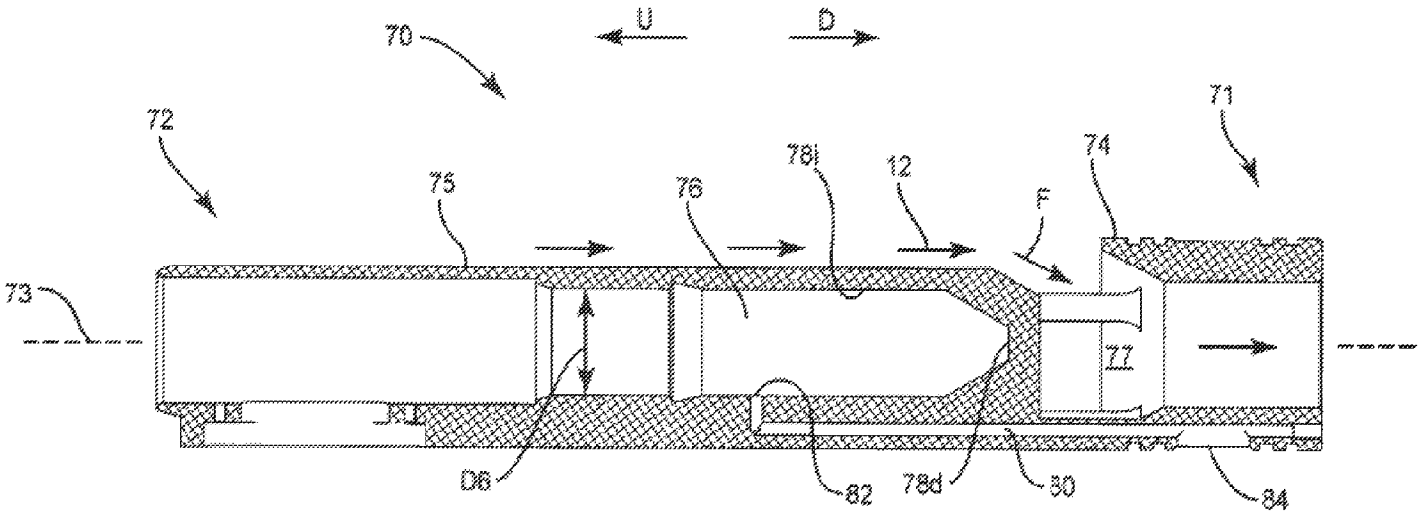
FIG. 3C is a sectional view of the a mule shoe taken through lines 3C-3C in FIG. 3B.

The mule shoe 70 illustrated in FIGS. 3A, 3B, and 3C is configured to be supported within the internal passage 12 of the drill collar assembly 36 of the drill string 6 (drill collar assembly 36 shown in FIG. 1C). The mule shoe 70 defines a bottom end 71, an uphole end 72 opposed to the bottom end, and an outer attachment surface 74. The mule shoe 70 may be attached to the inner surface 55 of the drill string 6 (FIG. 1C), whereby the outer attachment surface 74 of the mule shoe 70 is attached to the inner surface 55 of the drill collar assembly 36. The mule shoe 70 may be positioned within the drill string 6, such that, the bottom end 71 is located downhole with respect to the uphole end 72. The mule shoe 70 also defines an external passage 77 that extends partly through the mule shoe 70. Drilling fluid F traveling in the internal passage 12 passes through the passage 77 toward the drill bit 14 (not shown). The mule shoe 70 also defines a socket outer surface 75, an inner surface 78*i* (FIG. 3C) opposed to the outer socket surface 75, and a downhole inner surface 78*d*. The inner surfaces 78*i* and 78*d* of the mule shoe 70 defines the socket 76 that is shaped to receive probe 60. Mule shoe 70 can extend along a longitudinal axis 73, which extends through the bottom end 71 and the uphole end 72. The mule shoe longitudinal axis 73, when located within the drill string 6, preferably aligns with the central longitudinal axis 32 of the drill string 6. The socket 76 extends from the uphole end 72 to the downhole inner surface 78*d* along the longitudinal axis 73. Further, the mule shoe includes plurality of elongated supports 79 that extend partly from the uphole end 72 the bottom end 71, and radially outwardly from the outer surface 75 of the socket. The supports 79 partially define the outer attachment surface 74.

Referring to FIGS. 3A-3C and 4D, the receptacle member 70 includes at least one communication channel 80 that extends from the inner surface 78*i* to the outer surface 74. The channel 80 as an inner opening or port 82 that opens to the socket 76, and an outer opening or port 84 that opens to the outer surface 74 of the receptacle member 70. In the embodiment of the figures, outer opening 84 is located toward the bottom end 71 of the receptacle member 70 and the inner opening 82 is located in an uphole direction U toward the uphole end 72, with respect to the outer opening 84. In another embodiment, the inner opening 82 and the outer opening 84 may be aligned along an axis (not shown) that is perpendicular to and intersects the longitudinal axis 73; both openings 82 and 84 being the same distance from the uphole end 72 and the downhole end 71. When MWD tool 40 is inserted into receptacle member 70, the longitudinal axis 73 of the receptacle member 70 and the longitudinal axis 63 of the probe 60 align and the channel inner opening 82 may be open to the recess 68 of the probe 60. Further, the outer opening 84 of the channel 80 is in flow communication with an exit port 57 (FIG. 1C) defined by the drill collar segment 34*a*. The exit port 57 is open to the annular passage 13 between the drill string 6 and wall (not shown) of the borehole 2. A terminal port portion 86 extends from the opening 84 and may be used as relief port.

The mule shoe 70 is configured to allow the high pressure drilling fluid F to flow along the outer socket surface 75. During drilling operations, when the mule shoe 70 is supported by and located within the drill string 6, the drilling fluid F in the internal passage 12 may flow through the drill string 6, around mule shoe 70 along the outer socket surface 75, through the passage 77, through the drill bit 14, and then reverse direction in the annular passage 13.

Figure 4A:
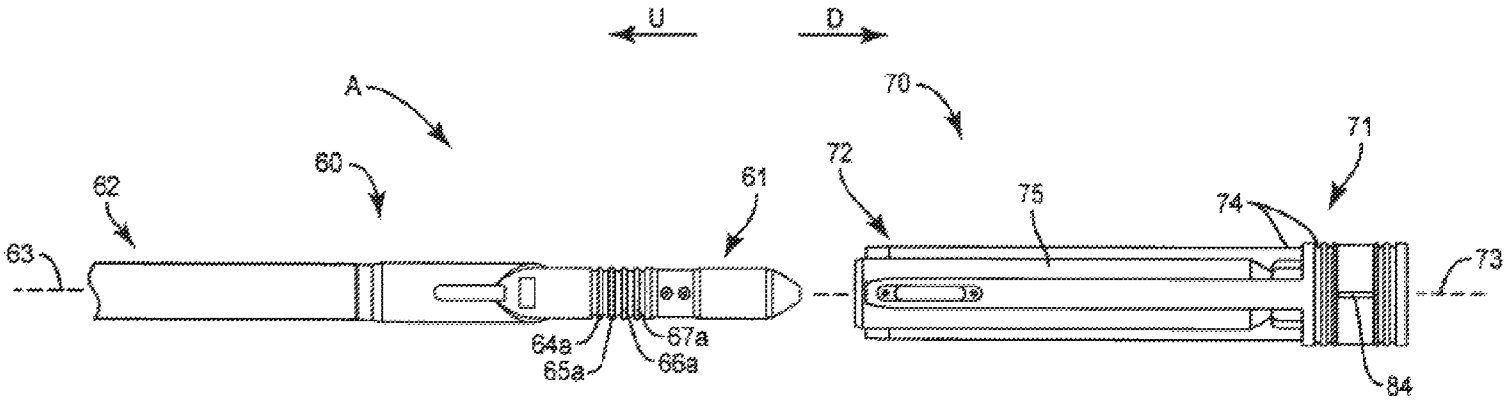
FIG. 4A is a side view of a pressure locking device including a downhole end of the MWD tool and the mule shoe shown in FIGS. 2A-3C, illustrating the MWD tool approaching the mule shoe.
Figure 4B:
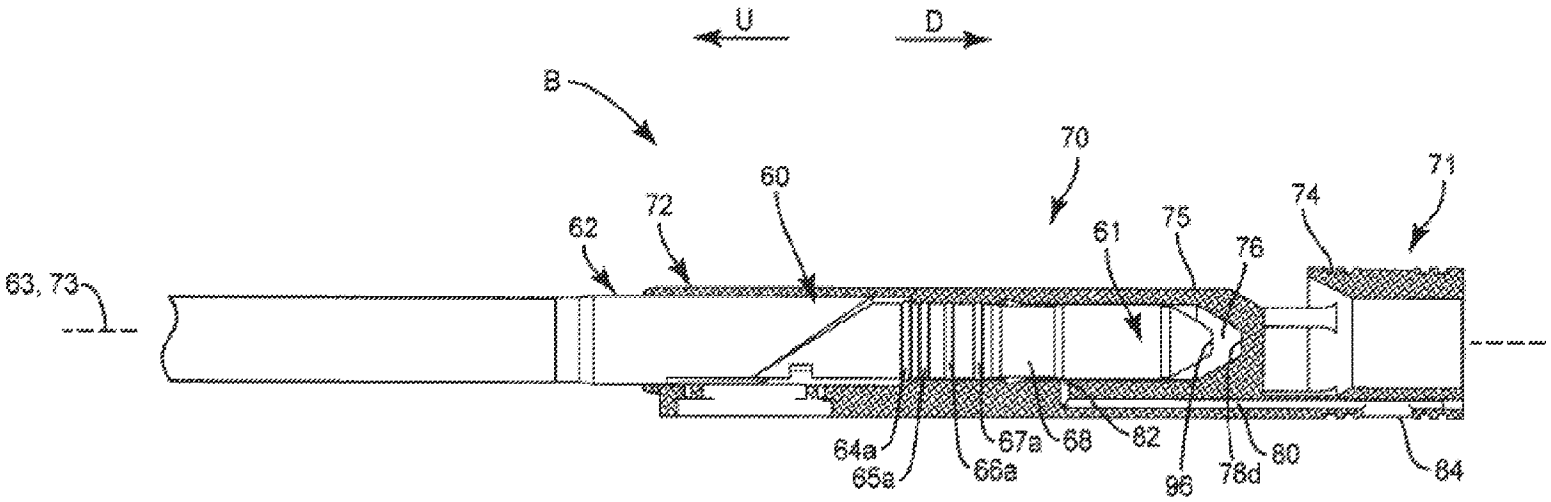
FIG. 4B is a side view of the downhole end of the MWD tool and a sectional view of the mule shoe shown in FIG. 4A, illustrating the downhole end of the MWD tool partially inserted into a socket of the mule shoe.
Figure 4C:
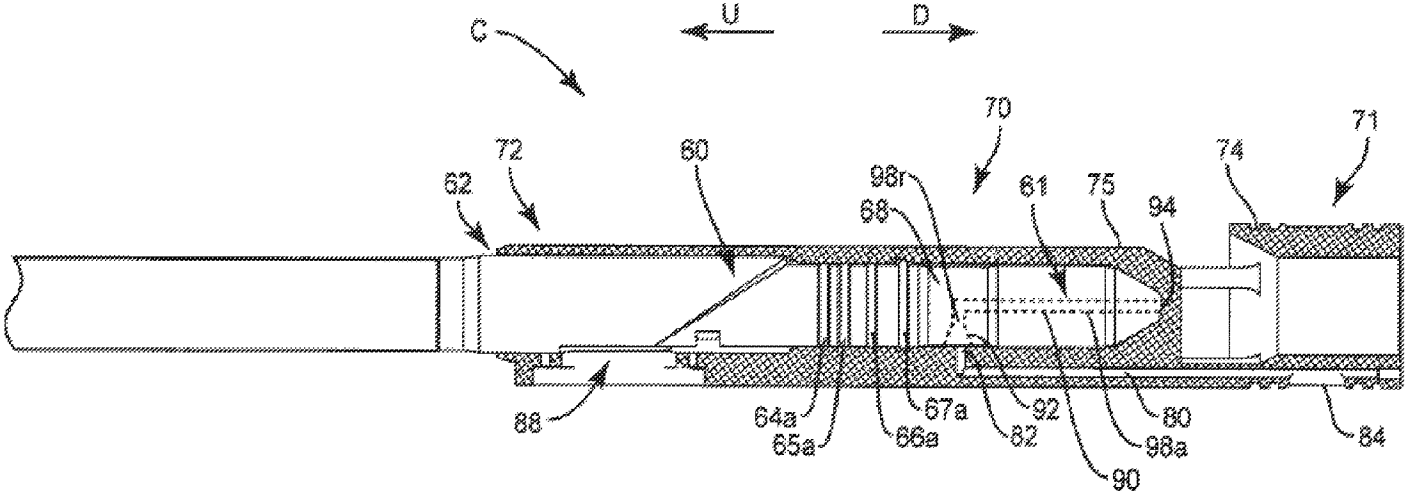
FIG. 4C is a side view of the downhole end of the MWD tool and a sectional view of the socket of the mule shoe shown in FIG. 4B, illustrating the MWD tool fully seated in the mule shoe.

Turning now to FIGS. 4A through 5, the operational sequence of seating the MWD tool 40 into the receptacle member 70 will be described. FIG. 4A illustrates a first or external position A whereby the MWD tool 40 is not positioned inside the mule shoe 70. The first position A is when the MWD tool 40 is being lowered into the mule shoe 70 during a make-up. Alternative, the position A could be after the MWD tool 40 has been retrieved and the same MWD tool 40 (or different MWD tool) is being positioned in the drill string 6 via a wireline. During this initial sequence, the MWD tool 40 travels in the downhole direction D toward the mule shoe. FIG. 4B illustrates a second or intermediate position B whereby the MWD tool 40 has advance further downhole and is partially inserted into the socket 76 of the mule shoe 70. During this intermediate sequence, the alignment members 69*a* position the probe 60 in the proper orientation in the mule shoe 70. During this sequence, drilling fluid (not shown) may captured in socket 76 between the downhole part 96 and the inner downhole surface 78*d*. Turning, to FIG. 4C, which illustrates a third or fully seated position C whereby the MWD tool 40, or the probe 60, is fully seated in the socket 76 of the mule shoe 70. When the probe 60 is received by the mule shoe 70 and is seated in the socket 76, the downhole end 61 of the probe 60 may be positioned toward the bottom end 71 of the receptacle member 70. Further, when the probe 60 is seated, the inner opening 82 of the channel 80 may be aligned with the recess 68 of the probe 60.

As best illustrated in FIGS. 4C and 5, during drilling, as explained above, drilling fluid F is pumped in the downhole direction D in the internal passage 12 under a high pressure P1 (FIG. 5). The pressure P2 of the fluid F in the annular passage 13 is lower than the pressure P1 in the internal passage 12 during drilling operation. The primary contributor to the pressure drop at the downhole end 56 of the drill string 6 is the drill bit 14, and/or mud motor, if used. Often, the pressure drop through the drill bit 14, or mud motor if used, is kept at a level between 500 psi and 1500 psi.

Continuing with FIGS. 4C and 5, the probe 60 is subjected to high pressure P1 drilling fluid at its uphole end 62 and on the uphole side of sealing elements 64*a*, 65*a* and is subjected to low pressure P2 drilling fluid on the downhole side of sealing elements 64*a*, 65*b*. In this regard, recess 68 located on the downhole side of sealing elements 64*a* and 65*a* is in communication with (that is, exposed to) low pressure P2 fluid on the exterior of drill string 6 via opening 84 and channel 80 and the exit port 57 of the drill collar segment 34*a*. The inner opening 82 opens into recess 68, which enables the equalization of pressure around the circumference of sealing elements 64*a*, 65*b*. The difference in pressure between the high pressure fluid in internal passage 12 and the low pressure fluid on the downhole side of sealing elements 64*a*, 65*b* creates a downward force on the probe 60 to retain it in the mule shoe 70 or restrain or counter uphole movement of probe 60 relative to the mule shoe 70. Further, if the socket 76 is filled with drilling fluid F advancement of the probe 60 downhole forces trapped drilling fluid F into the port opening 92, through the channel 90, and out the port opening 94. The drilling fluid F is forced through the channel 80 and out of the drill string 6 into the annular passage 13, in part because the pressure in the passage 13 is lower than the pressure within the drill string 6 and socket 76, as discussed above. The probe channel 90 also prevents hydrolocking.

Accordingly, when drilling fluid F is being pumped through drill string 6 to create a differential pressure across sealing elements 64*a*,65*a* that acts to seat the probe 60 into mule shoe 70. But when the pumps are not in operation, the flow of drilling fluid F stops and the pressure equalizes across sealing element 64*a*, 65*a*. Even though the hydrostatic pressure is high, there is no downward force created by the pressure, which enables the probe to be removed by conventional means, such as a wireline that can be attached to a spar (not shown in the figures) on the uphole side of probe side, will be understood by persons familiar with retrievable MWD tools.

A pressure locking device 20, including the probe 60, sealing elements, and receptacle member 70 has been described with reference to MWD tools. However, in alternative embodiments, the pressure locking device 20 can be used with any downhole tool configured or positioned inside a drill string. Further, downhole tools may or may not have a "probe" as that term is understood in the oil and gas drilling arts. Accordingly, the probe as described herein can a downhole member or downhole component of a downhole tool. Further, the present disclosure has described that the probe 60 includes sealing elements 64*a*, 65*a*, an electrical contact component 66*a*, and a locking element 67*a* seated in respective grooves. In alternative embodiments, the inner surface 78*i* of the receptacle member 70 can define annular grooves (not shown) and the sealing elements 64*a* and 65*a* can be disposed in the grooves of the receptacle member 70 so as to create a seal between the probe 60 and the receptacle member 70. Further, either or both of the locking element and electrical contact element 66*a* can be supported by the inner surface 78*i* of the receptacle member 70. In addition, the recess 68 in the probe 60 is optional. In embodiments having no recess 68, low pressure fluid may communicate with the downhole side of the sealing elements 64*a*, 65*b* via the channel 80. Alternatively, the inner opening 82 of a channel may open to a portion of the socket 76 located closest to the bottom end 71 of the mule shoe 70 to expose the downhole-most part 96 of downhole end 61 of the probe 60 to the low pressure fluid. In the embodiment shown in the figures or the alternative embodiments described in this paragraph, the pressure differential across sealing elements 64*a* and/or 65*a* seats the MWD tool 40 securely in place. In still other embodiments, the downhole tool or MWD tool can include a structure that defines a socket, similar the socket 76, and the drill collar segment 34 can support an elongated member, similar to the probe 60, that extends in the uphole direction and is supported in the passage 12. In such an embodiment, the sealing elements can be disposed in the socket or on the elongated member.

The present disclosure is not limited to the particular embodiments shown or described. For merely a few examples, the present disclosure is not limited to sealing elements in the form of rings that define the seal between the high pressure fluid and the low pressure fluid. Rather, any seals or like structure is contemplated. The mule shoe may include multiple channels (analogous to channel 80) and opening to expose a downhole side of the MWD tool to low pressure fluid.

And generally, the disclosure is described herein using a limited number of embodiments, these specific embodiments are not intended to limit the scope of the disclosure as otherwise described and claimed herein. Modification and variations from the described embodiments exist. More specifically, the following examples are given as a specific illustration of embodiments of the claimed disclosure. It should be understood that the invention is not limited to the specific details set forth in the examples.

What is claimed:

1. A drilling system including a drill string for forming a borehole in an earthen formation, the drilling system comprising:

a drill collar segment configured to be disposed along the drill string, the drill collar segment including a passage configured for high pressure drilling fluid to flow through in a downhole direction when the drill collar segment is disposed along the drill string, the drill collar segment configured such that the high pressure fluid drops in pressure across a downhole end of the drill string, thereby resulting in lower pressure drilling fluid on an exterior surface of the drill collar segment;

a mule shoe coupled to the drill collar segment, the mule shoe including a socket;

a probe configured to be positioned in the passage of the drill collar segment, the probe having a downhole end configured to be disposed in the socket; and at least one sealing element coupled to one of the probe or the mule shoe so as define a seal between the probe and the mule shoe, the sealing element defining an uphole side of the probe and a downhole side of the probe, the uphole side of the probe being in communication with the high pressure drilling fluid and the downhole side being in communication with the low pressure drilling fluid, whereby the pressure differential between the high pressure fluid and the low pressure fluid applies a force to the probe in the downhole direction, and the probe further comprises at least one alignment member on the uphole side of the probe, a recess on the downhole side of the probe between the downhole end and the at least one sealing element, and an internal channel having a first port disposed in the recess and a second port that is open to the downhole end of the probe, whereby the internal channel allows drilling fluid to be displaced from the socket to the recess when the probe is inserted into the mule shoe.

2. The drilling system of claim 1, further comprising a downhole tool, wherein the downhole tool includes the probe.

3. The drilling system of claim 2, wherein the downhole tool is a measurement-while-drilling (MWD) tool.

4. The drilling system of claim 1, wherein the at least one sealing element is a compliant member.

5. The drilling system of claim 4, wherein the compliant member is an o-ring located in a groove in the probe.

6. The drilling system of claim 1, wherein the internal channel allows fluid communication between an exterior surface of the drill collar segment and the downhole side of the probe.

7. The drilling system of claim 1, wherein the probe includes a locking element configured to hold the probe in position in the mule shoe when fluid is not flowing through the passage.

8. The drilling system of claim 1, wherein the at least one alignment member includes a pair of ledges that extend helically around at least a portion of the probe.

9. The drilling system of claim 1, wherein the at least one alignment member includes a keyed recess that is configured to receive a complimentary feature defined by the mule shoe.

10. The drilling system of claim 1, wherein the recess extends substantially around an entirety of the probe.

11. A drilling system including a drill string and a drill bit configured to define a borehole in an earthen formation during a drilling operation, the drilling system comprising:

a drill collar segment configured to be disposed along the drill string, the drill collar segment defining an inner surface, an outer surface, an exit port that extends from the inner surface to the outer surface, an uphole end, a downhole end spaced from the uphole end in a downhole direction, and a passage that extends from the uphole end to the downhole end in the downhole direction, the passage configured to allow a fluid to flow therethrough;

a downhole tool configured to be positioned in the passage, the downhole tool having a first end and a second end that is opposed to the first end in the downhole direction; and a receptacle member supported by the inner surface of the drill collar segment, the receptacle member defining a socket configured to engage the second end of the downhole tool, and a channel that is open to the socket and to an outer surface of the drill collar segment through the exit port of the drill collar segment, wherein engagement between the second end of the downhole tool and the socket forms a seal between the downhole tool and the receptacle member, whereby when fluid flows through the passage during the drilling operation, a differential pressure between a high pressure fluid at an uphole side of the seal and a lower pressure fluid on a downhole side of the seal applies a force to the downhole tool in the downhole direction, so as to retain the downhole tool in the receptacle member.

12. The drilling system of claim 11, further comprising at least one sealing element coupled to either the downhole tool or the receptacle member, the at least one sealing element defining the seal between the downhole tool and the receptacle member when the downhole tool is received by the socket and drilling fluid is flowing through the passage.

13. The drilling system of claim 12, wherein the downhole tool includes a probe.

14. The drilling system of claim 13, wherein the probe includes the at least one sealing element.

15. The drilling system of claim 14, wherein the probe defines a recess spaced from the at least one sealing element in the downhole direction.

16. The drilling system of claim 11, wherein the downhole tool includes the at least one sealing element.

17. The drilling system of claim 16, wherein the downhole tool defines at least one recess that is open to the channel when the downhole tool is received by the socket, wherein the lower pressure fluid is disposed in the recess during the drilling operation.

18. The drilling system of claim 11, wherein the downhole tool includes a locking element configured to hold the downhole tool in position in the receptacle member when fluid is not flowing through the passage.

19. The drilling system of claim 11, wherein the downhole tool is a measurement-while-drilling (MWD) tool.

20. The drilling system of claim 11, wherein the second end of the downhole tool defines an internal channel, wherein the internal channel has a first port disposed along an outer surface of the downhole tool and a second port that is open to the second end of the downhole tool, whereby the internal channel allows drilling fluid to be displaced from the socket through the internal channel when the downhole tool is inserted into the receptacle member.

21. The drilling system of claim 11, wherein the downhole tool further comprises at least one alignment member on the uphole side of the seal and a recess on the downhole side of the seal between the second end and the seal.

22. The drilling system of claim 21, wherein the recess extends substantially around an entirety of the downhole tool.

* * * * *